United States Patent [19]

Olivieri

[11] 4,020,571

[45] May 3, 1977

[54] LACING DEVICE FOR SKI BOOTS

[76] Inventor: Icaro Olivieri, 10, via Feltrina Nord, Montebelluna, Italy, 31044

[22] Filed: June 25, 1976

[21] Appl. No.: 699,700

[30] Foreign Application Priority Data

July 4, 1975 Italy ..... 12685/75

[52] U.S. Cl. ..... 36/50; 24/70 SK

[51] Int. Cl.[2] ..... A43B 11/00; A43C 11/00

[58] Field of Search ..... 36/50; 24/69 SK, 71 SK, 24/81 SK, 70 SK, 68 SK

[56] References Cited

UNITED STATES PATENTS

| | | | |
|---|---|---|---|
| 3,204,307 | 9/1965 | Dunn | 36/50 |
| 3,956,796 | 5/1976 | Guolo | 36/50 |
| 3,967,391 | 7/1976 | Kastinger | 36/50 |

*Primary Examiner*—Patrick D. Lawson

*Attorney, Agent, or Firm*—Marvin Feldman; Stephen E. Feldman

[57] ABSTRACT

A lacing device for ski boots comprises a hooked lever-like lacing member provided on one flap of the boot which cooperates with a ring-like lacing member provided on the other flap of the boot. The said lacing members are anchored to the boot flaps by providing on the said flaps a corresponding number of projections presenting an enlarged head. An elastic open ring made of steel wire is divaricated by its end portions, which are coaxially directed the one towards the other, so that it can be inserted around the corresponding projection on the flap. The divaricated end portions of the ring are then released so as to close towards each other, and penetrate into borings or side cavities provided at the extremities of the lacing members, thus ensuring an articulated anchoring of the said lacing members to the boot flap.

6 Claims, 4 Drawing Figures

LACING DEVICE FOR SKI BOOTS

BACKGROUND AND SUMMARY OF THE INVENTION

The present invention relates to a lacing device for ski boots, and more particularly to novel means for anchoring the two members composing the said lacing device to the ski boot.

The modern ski boots are provided with a number of lacing devices each comprising a hooked lever like member cooperating with a ring like member. The said members are fastened to base plates, which in turn are secured to the ski boot upper, at both sides of the longitudinal opening formed in the upper, usually by means of rivets.

In the event that one of the said devices becomes irreparably damaged, its substitution is very difficult, and may be accomplished only by a skilled person with the aid of special tools and with the serious risk of damaging the ski boot.

The invention aims to obviate to the above drawbacks of the prior art lacing devices, by providing a lacing device which may be easily assembled and disassembled from a ski boot, without the need of special tools, and without the danger of damaging the ski boot.

BRIEF DESCRIPTION OF THE DRAWINGS

Further objects and advantages of the invention will appear evident from the following specification, made with reference to the accompanying drawings, in which.

DESCRIPTION OF THE PREFERRED EMBODIMENT

Figure 1:
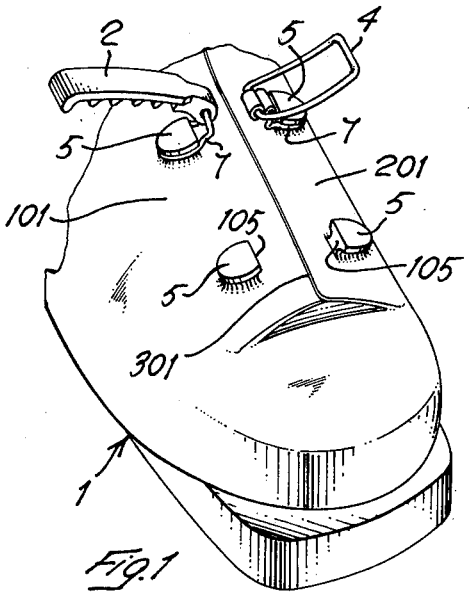
FIG. 1 is a perspective view of the broken away front portion of a ski boot provided with a lacing device according to the invention.
Figure 4:
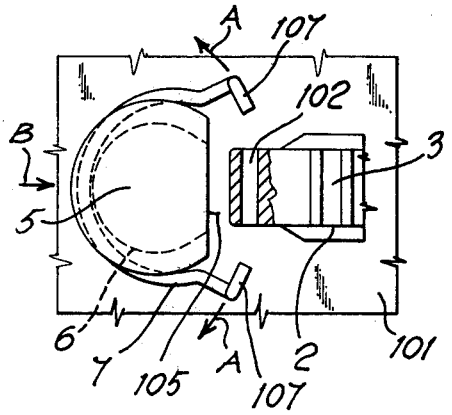
FIG. 4 is a view from the top showing a detail of the operation for the anchoring to the boot of a member of the lacing device.
Figure 2:
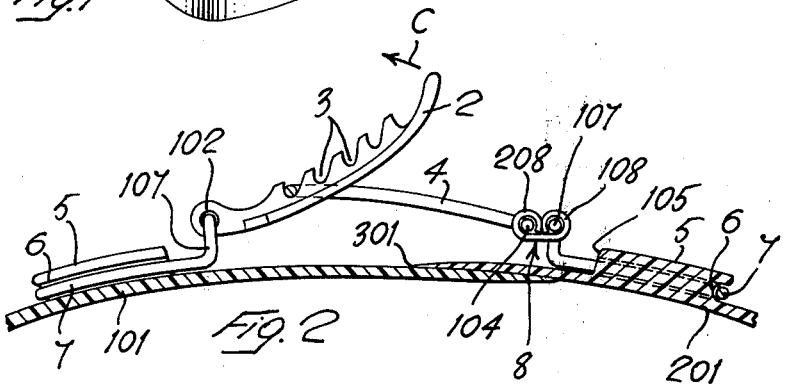
FIG. 2 is an enlarged transversal section of the lacing device.
Figure 3:
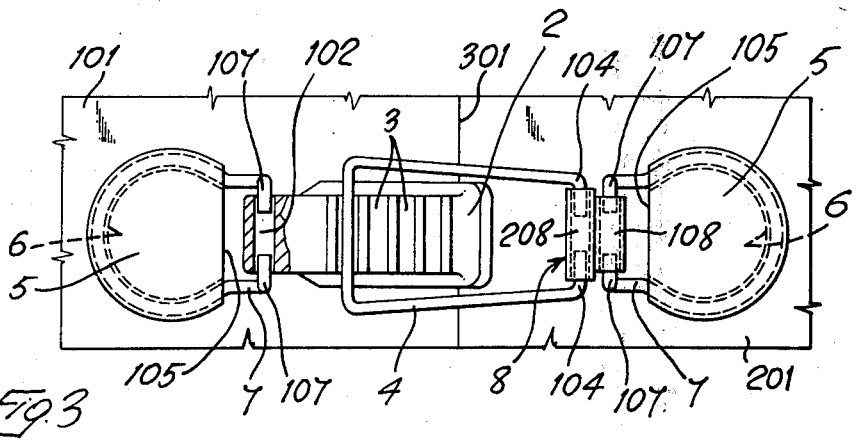
FIG. 3 is a view from above of the lacing device of FIG. 2.

With reference to FIG. 1, numeral 1 denotes a ski boot made of plastic material. The ski boot upper is provided, in a conventional manner, with two closure flaps 101, 201, which define between them the longitudinal opening 301. To the said flaps 101, 201 the lacing devices are secured. Each lacing device consists of two known parts, that is a first lacing member in the form of a lever arm 2 provided with a plurality of hook like indentations 3, which is hingedly secured to one flap (in the present case flap 101) and is intended to cooperate, in the manner best shown in FIG. 2, with a second lacing member in the form of a ring like element 4, which is hingedly secured to the other flap 201. In order to provide to the securing or anchoring of the two lacing members to the said flaps 101, 201, on each flap in alignment relationship with respect to the opening 301 there are provided a plurality of projections 5 presenting an enlarged head, so as to create, between the said enlarged head and the surface of the flap, an annular groove or recess 6. Each projection 5 (see particularly FIGS. 3 and 4) is preferably constructed circular as viewed from the top and presents, in correspondence of the side of the flap facing the opening

301 (and consequently the opposed corresponding projection 5 provided on the other flap), a flattened portion 105, as a chord intersecting the circular outline of the said projection. The proper anchoring element consists of an open ring 7 made of suitable strong elastic material, such as steel wire, which presents a circumference substantially equal or slightly lesser than the circumference of the groove or recess 6 of projection 5, and presents two coaxially bent, inwardly directed ends 107.

The extremity of the hooked lever lacing member 2 which is intended to be hingedly secured to the flap is provided with a transversal through boring 102. The extremity of the ring-like lacing member 4 which is intended to be secured to the other flap is hingedly mounted on an intermediate articulation member 8 in the form of a small plate presenting two rolled up portions which define two transversal cavities 108 and 208. Inside cavity 208 there are inserted inwardly directed coaxial the extremities 104 of the ring-like lacing member 4, which lacing member 4 is thus hingedly secured to said intermediate articulation member or plate 8.

The anchoring of the two lacing members 2 and 4 takes place as follows (see particularly FIG. 4):

The coaxially inwardly directed end portions 107 of the ring 7 are divaricated (arrow A) so as to consent the insertion of the ring (see arrow B) around the projection 5, into the groove or recess 6. The extremity of the lacing member to be hingedly secured (which may be the extremity of lever 2 provided with through boring 102, or the extremity of the intermediate articulation member 8, which carries the ring-like lacing member 4, presenting the transversal cavity 108), is arranged in proximity of the flattened chord portion 105 of the projection 5. At this point, the ends 107 of ring 7 are released, and due to the elasticity of the ring, the said ends penetrate inside the cavities 102 (for lacing member 2) or 108 (for lacing member 4). In this manner, it appears evident that a safe and steady anchoring, in an articulated manner, of both lacing member 2 and 4 on the respective flaps of the ski boot upper has been obtained. If, due to any reason such as breakage, malfunctioning or any other defect, a lacing member must be substituted, it will be simply sufficient to divaricate again the ends 107 of the ring 7, thus allowing the removal of the said lacing member. It will be appreciated that no particular tool is required, but any suitable tool which can provide for the divarication of the ends 107 of ring 7.

It is to be noted that the presence of the intermediate articulation plate 8 is not absolutely necessary for the anchoring of lacing member 4, but the said lacing member 4 can be constructed so as to present, similarly to lacing member 2, an end portion provided with suitable cavities or borings for the insertion of the extremities 107 of ring 7.

Concerning the projection 5, it must be eventually noted that same may be obtained of one piece with the ski boot flap, during the molding of the ski boot upper, or it may be constructed as a separate button-like member which is fastened in any suitable manner to the ski boot flap, as for instance by riveting, or by embedding at the moment of the molding of the ski boot upper.

It is believed that the invention will have been clearly understood from the foregoing detailed description of a preferred embodiment of same. Changes in the details of construction may be resorted to without departing from the spirit of the invention, and it is accordingly intended that no limitation be implied and that the hereto annexed claims be given the broadest interpretation to which the employed language fairly admits.

I claim:

1. In a ski boot of the type comprising a ski boot upper provided with two flaps defining an opening, a lacing device including a hooked lever-like lacing member provided on one flap intended to cooperate with a ring-like lacing member on the other flap, said lacing members being secured hingedly and in a removable manner to the said flaps at the sides of the opening, by means of anchoring elements, each anchoring element consisting of an elastic open ring presenting end portions coaxially directed towards each other, said open ring being anchored on a correspondingly shaped projection provided on the ski boot flap, so as to encircle said projection and penetrate with its coaxially directed end portions inside corresponding side cavities or borings located in correspondence of the extremities of the lacing members.

2. A lacing device according to claim 1, in which the projection provided on the ski boot flap presents at least partially an enlarged head.

3. A lacing device according to claim 1, in which the projection provided on the ski boot flap presents at least partially a peripheral groove for housing a corresponding portion of the elastic open ring.

4. A lacing device according to claim 1, in which the elastic open ring for the anchoring of the lacing members is made of steel wire.

5. A lacing device according to claim 1, in which the ring-like lacing member presents in correspondence of its extremity an intermediate articulation member hingedly connected to the said extremity and presenting suitable side cavities or borings for engagement by the coaxially directed end portions of the elastic anchoring ring.

6. A lacing device according to claim 1, in which the ski boot upper is made of plastics and the projections provided on the flaps are obtained of one piece with the said flaps.

* * * * *